US005090349A

United States Patent [19]

Wilson

[11] Patent Number: 5,090,349

[45] Date of Patent: Feb. 25, 1992

[54] TRAFFIC SAFETY CONE

[75] Inventor: David L. Wilson, Getzville, N.Y.

[73] Assignee: American Allsafe Company, Tonawanda, N.Y.

[21] Appl. No.: 655,059

[22] Filed: Feb. 14, 1991

[51] Int. Cl.[5] ..... E01F 9/04; E01F 13/00; E01F 15/00

[52] U.S. Cl. ..... 116/63 C; 404/6

[58] Field of Search ..... 116/63 C, 63 P, 63 T, 116/63 R; 229/113; 404/6, 9; 40/539, 612

[56] References Cited

U.S. PATENT DOCUMENTS

| | | | |
|---|---|---|---|
| 692,561 | 2/1902 | Webb | 229/153 |
| 2,908,437 | 10/1959 | Wiedenmeier | 229/127 |
| 2,935,238 | 5/1960 | Koehler | 116/63 P |
| 3,100,074 | 8/1963 | Beck | 229/113 |
| 3,195,255 | 7/1965 | Toulmin, Jr. | 116/63 P |
| 3,365,134 | 1/1968 | Oberreich | 229/153 |
| 3,371,845 | 3/1968 | Freiman | 229/127 |
| 3,485,202 | 12/1969 | Platt | 116/63 T |
| 4,466,376 | 8/1984 | Wells | 116/63 C |
| 4,798,747 | 1/1989 | Laramee | 116/63 C |
| 4,925,334 | 5/1990 | Beard | 116/63 C |

FOREIGN PATENT DOCUMENTS

| | | | |
|---|---|---|---|
| 0218771 | 4/1987 | European Pat. Off. | 116/63 C |
| 2049767 | 12/1980 | United Kingdom | 116/63 C |

*Primary Examiner*—William A. Cuchlinski, Jr.
*Assistant Examiner*—John L. Beres
*Attorney, Agent, or Firm*—Bernard A. Reiter

[57] ABSTRACT

This invention is a folding warning marker device with multiple panels formed from a sheet of cardboard or other folding material. For exemplary purposes, the invention herein is shown as a four sided truncated cone having various warning indicia on the surface. It is characterized by ease of stacking and storage and toward that end can be stored in a flat layout condition. Disposed at the top of the cone is a vertical slit on opposing sides allowing for the insertion of a ribbon fence from one safety cone to the next thereby cordoning off an area of danger. The top of the truncated cone is characterized by a flap that folds over the slits in order to thus fasten the ribbon passing through to the safety cone. The bottom of the safety cone is characterized by folding flaps thus forming a base of a cone and thus securely holding the structure in place.

9 Claims, 2 Drawing Sheets

TRAFFIC SAFETY CONE

BACKGROUND OF THE INVENTION

1. Field of Invention

This invention relates to marker devices for alerting or warning of some danger or unusual condition at particular locations. More particularly, this device is intended to cordon off an area of hazard or activity from pedestrian or other traffic passing in the area.

2. Description of Related Art

The relevant prior art include the Laramee, Wells and Wilson patents, carrying, respectively, U.S. Pat. Nos. 4,798,747, 4,466,376 and 3,782,322. The Laramee patent is a semi-finished sheet, making a disposable warning marker device. The marker device has three major side panels of trapezoidal configuration and a minor bottom panel of triangular configuration. The sheet is folded along fold lines with tabs to lock the structure into position, forming a pyramid with an open top. However, the Laramee invention lacks ribbon fencing provisions to cordon off an area as disclosed in the present invention. In addition, the inventions flap and slot combination used to hold the structure together eventually wears down and tear off thereby diminishing the utility of the invention. The present invention avoids this pitfall by eliminating flap and slot combination to hold the structure together. In addition, it provides for a ribbon fencing combination.

The Wells patent (U.S. Pat. No. 4,466,376) creates a traffic cone with a more complex structure than Laramee patent or the present invention. The marker device is assembled from two separate sheets involving a number of folding processes and then connecting the two folded sheets. This device also does not provide for ribbon fencing provisions as disclosed in the present invention. Assembly is relatively cumbersome, and over continual use, the attaching flaps will wear down requiring a new device. The Wells patent does not make assembly, disassembly or storage very convenient or easy because of its two sheet structure.

The Wilson patent (U.S. Pat. No. 3,782,322) contemplates a lightweight plastic marker device comprising a hollow, substantially conical base made of elastic material. The base is provided with an opening at the top where a flexible shaft may have its lower end removably engaged in the opening in a substantially upright position. The shaft at its upper end is characterized by a slit, where a streamer or a pennant is inserted and secured by a cap and a pin through a hole in the shaft and the pennant. The Wilson patent contemplates a distinct use and objective to that contemplated by the Laramee, Wells, or the present inventions. It is most commonly applicable for use in sporting events. The Wilson patent contemplates a number of distinct pieces which each require separate storage facilities. For example, the shafts of the Wilson patent will need a storage box of some sort and could not readily be stacked in one area. The same is true of the conical base of the marker device, and the pin and caps for holding the pennants. Thus, Wilson patent does not provide for relatively convenient storage or disposal capabilities.

SUMMARY OF THE INVENTION

It is an object of the present invention to provide a unitary, inexpensive, lightweight folding sheet serving as marker device which is easily handled and stored, or discarded. It provides durability when made of cardboard stock or folding plastic, yet it can be easily discarded when made of degradable paper or cardboard stock. The invention additionally contemplates an easy fencing means to cordon off any activity prone or dangerous areas with a simple slot, flap and ribbon combination. This unique combination provides an invention that may be readily assembled, displayed, disassembled, and stored comprising a single unitary body through which the ribbon or other fence like means can be easily and securely affixed or removed with no separate operative parts. The sheet costs a fraction of other conventional marker devices yet are more easily stored, assembled, or discarded.

The manufacture of the warning marker device is conveniently done through a stamping process by stamping from a blank sheet of suitable coloration of cardboard or other material. The sheet is then folded into shaped and attached requiring little further assembly of the device.

The structure also provides better durability over conventional cardboard marker devices because no portion of the warning marker device wears down or tears off which would eliminate the utility of the device. This device is especially suited for continual assembly and disassembly because of its unique design. In the present claim, no tabs exist which would eventually wear down and tear off to lose its effective utility. The present design of the warning marker device has a further advantage in the amount of storage space required over both conventional plastic and cardboard marker devices. The present design calls for storage by unfolding the top and bottom (minor) panels, and flattening the structure so that two major panels are folded over the remaining two major panels for easy stacking in a smaller storage area.

Another advantage offered by the present invention over the conventional cardboard marker device is its capability to add a ribbon fencing from one marker device to the next to cordon off a dangerous or activity prone area. A vertical slit at the top of the warning marker device on two sides of the major panels provides a means through which the ribbon fencing may be passed from one safety marker device to the next to create the fence.

DETAILED DESCRIPTION OF THE PREFERRED EMBODIMENT

Figure 2:
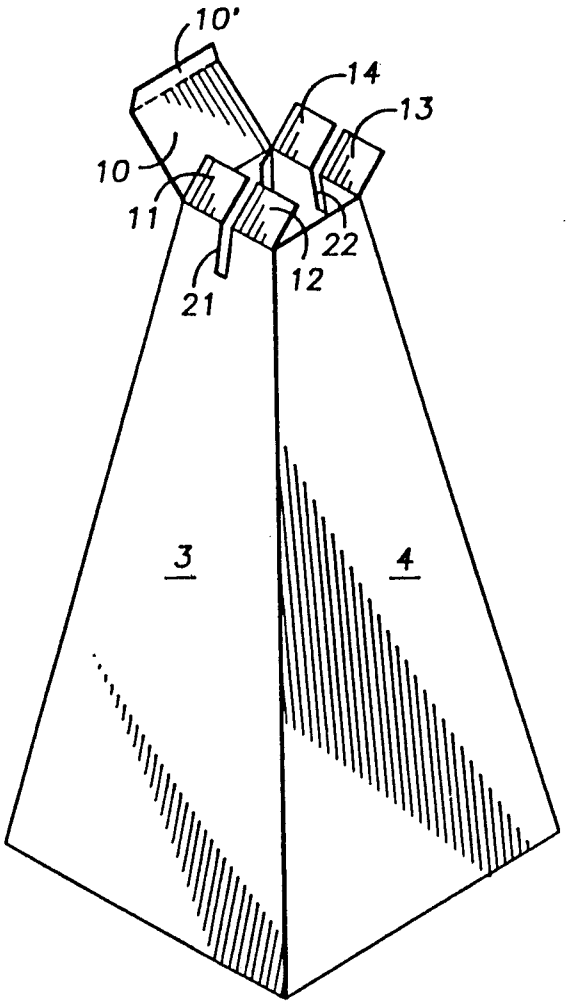
FIG. 2 illustrates the assembly required of the top (minor) panels of the warning marker device.
Figure 1:
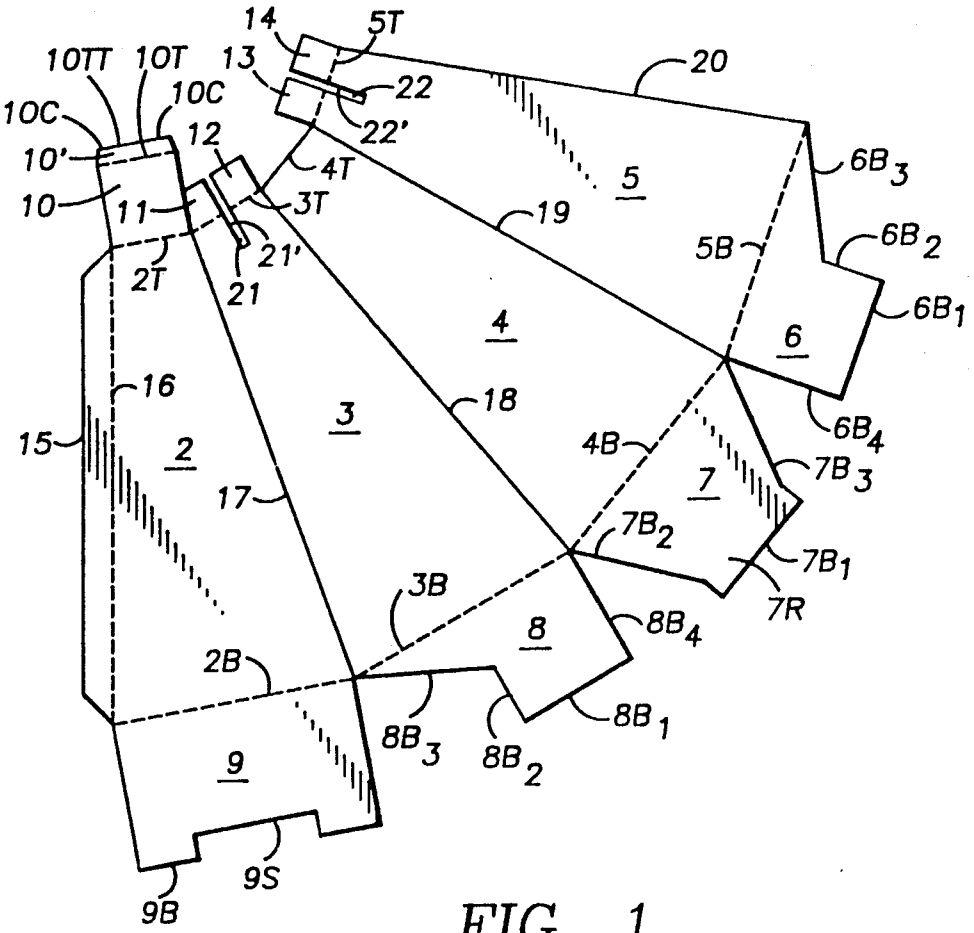
FIG. 1 is a plan view of the stamped sheet prior to factory assembly of the first and fourth major panels.

Referring now to FIG. 1, the warning marker device 1 comprises identical first, second, third and fourth major panels 2, 3, 4, and 5 and nine minor panels 6, 7, 8, 9, 10, 11, 12, 13 and 14. Major panels 2, 3, 4, and 5 are &rapezoidal in configuration having top fold lines 2T, 3T, 4T, 5T and bottom parallel fold lines 2B, 3B, 4B, 5B.

The first major panel 2 has an outside flange edge 15 with two inner side edges defined by fold lines 16 and 17. The first major panel 2 has a top edge defined by a fold line 2T and a bottom edge defined by a fold line 2B.

The first major panel 2 is further joined at its top fold line 2T, by a minor top panel 10 forming a closure flap. This minor top panel 10 has an inner fold line 10T near its top edge 10TT forming a flange $10^1$ locking the closure flap 10 in the truncated pyramid 1. The minor top panel 10 also has curved edges 10C at its top corners for easy insertion of the closure flap 10 into the truncated pyramid 1. The first major panel 2 is joined at its bottom fold line 2B by a minor bottom panel 9, and said minor bottom panel 9 is one of four minor bottom panels 6,7,8,9 forming the base of the truncated pyramid 1. This minor bottom panel 9 has a rectangular recess 9S at its bottom edge 9B facilitating assembly of the base of the truncated pyramid 1 by insertion of an opposing minor bottom panel 7 having a flap 7R into the recess 9S forming a locking fit.

The second major panel 3 is contiguous to the first major panel 2 and its side edges are defined by two fold lines 17 and 18. The top edge of the second major panel 3 is defined by fold line 3T, and its bottom edge defined by fold line 3B. The second major panel 3 is joined at its top fold line 3T by two minor top panels 11 and 12. These minor top panels 11 and 12 are separated by a slit $21^1$ which reaches to the fold line 3T. The slit $21^1$ further continues into the second major panel 3 forming a slot 21 for the insertion of a fencing ribbon X from one truncated pyramid 1 to the next. These minor top panels 11, 12 prevent the top portion of the truncated pyramid 1 from buckling or from becoming enlarged by providing support to the, "fold line 2T and edge 4T" and which also keeps the slot 21 in shape. The second major panel 3 is joined at its bottom fold line 3B by a minor bottom panel 8 forming one of two opposing folding flaps providing a locking structure for the truncated pyramid base. This minor bottom panel 8, a polygon in configuration, is characterized at its top edge by fold line 3B and at its bottom edge by an outside parallel edge 8B1. The minor bottom panel 8 has a third outside edge 8B4 normal to said parallel top and bottom edges 3B. The fourth outside edge 8B2 is parallel to the third edge 8B4, while the fifth outside edge 8B3 meets the top edge 3B at an acute angle, while meeting the fourth outside edge 8B2 at an obtuse angle.

The third major panel 4 is contiguous to the second major panel 3 and its side edges are defined by fold lines 18, 19. The top edge of the third major panel 3 is defined by an outer edge 4T, and its bottom edge defined by fold line 4B. The third major panel 4 is joined at its bottom edge 4B by a minor bottom panel 7. This minor bottom panel 7, a polygon, has its top edge, a fold line 4B, and a parallel bottom edge 7B1. Its sides 7B2, 7B3 begin at the fold line 4B and taper toward the bottom edge 7B1 ending in a bottom rectangular flap 7R. The rectangular flap 7R formed at the bottom edge 7B1 is inserted in the rectangular recess 9S cut out in minor panel 9

The fourth major panel 5 is contiguous to the third major panel 4 and its side edges are defined by a fold lines 19 and outside edge 20. The top edge of the fourth major panel 5 is defined by fold line 5T, and its bottom edge defined by fold line 5B. The fourth major panel 5 is joined at its top fold line 5T by two minor top panels 13 and 14. These minor top panels 13 and 14 are separated by a slit $22^1$ which reaches to the fold line 5T. The slit $22^1$ further continues onto the fourth major panel 5 forming a slot 22 for the insertion of a fencing ribbon X from one truncated pyramid 1 to the next. These minor top panels 13, 15 prevent the top portion of the truncated pyramid 1 from becoming enlarged or crushed by providing support to the fold line 2T and edge 4T and thereby also to keep the slot 22 in shape. The fourth major panel 5 is joined at its bottom fold line 5B by a minor bottom panel 6 forming one of two opposing folding flaps providing a locking structure for the truncated pyramid base. This minor bottom panel 6, a polygon in configuration, is characterized at its top edge by fold line 5B and at its parallel bottom edge by an outside edge 6B1. The minor bottom panel 6 has a third outside edge 6B4 normal to said parallel top and bottom edges 5B. The fourth outside edge 6B2 is parallel to the third edge 6B4, while the fifth outside edge 6B3 meets the top edge 5B at an acute angle, while meeting the fourth outside edge 6B2 at an obtuse angle. The fourth major panel 5 is the same in every respect to the second major panel 3 with the exception of that minor bottom panel 6 is the inverse of minor bottom panel 8.

Figure 4:
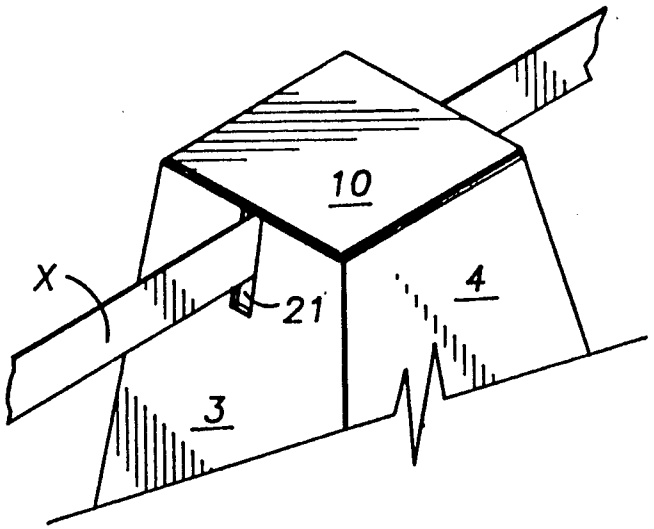
FIG. 4 illustrates the ribbon-like fencing means inserted in the slots and running through the device.
Figure 3:
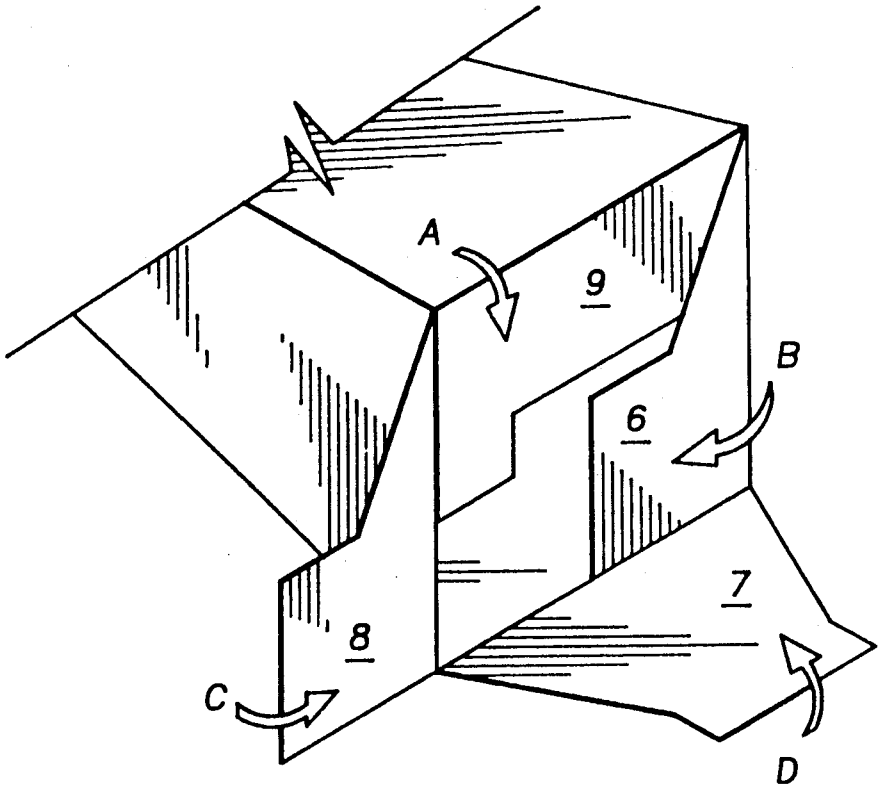
FIG. 3 illustrates the assembly required of the bottom (minor) panels of the warning marker device.

FIG. 3 shows assembly directions of the minor panels forming the base of the safety cone. FIG. 4 shows the FIG. 1 sheet assembled to form a safety cone with fencing options by folding over minor top panels 11, 12, 13, and 14, and closing the minor top panel 10 forming the closure flap 10 at the top of the truncated pyramid 1. The minor top panel 10 is folded at the fold line near the top edge 10TT and the bottom fold line 2T to close the closure flap 10 of the warning marker device. The base of the warning marker device is formed by first folding over minor bottom panel 9. The two identical opposing minor bottom panels 6 and 8 are then folded in. A final step involves folding over minor bottom panel 7 and inserting the rectangular flap 7R into the rectangular slot formed by the rectangular recess 9S in minor bottom panel 9

The warning marker device 1 is partially assembled upon manufacture of the semi-finished sheet by having the first and fourth major panels 2, 5 permanently attached. The attached area is along the outer edge 15 and up to the fold line 16. Thus, the outside edge 20 of the fourth major panel is attached to the area between the outer edge 15 and the inner edge fold line 16. This area remains attached when the warning marker device is disassembled and stored when the first and second major panels 2, 3 remain folded over the third and fourth major panels 4, 5 in a flat manner.

Although a detailed embodiment of the present invention is disclosed herein, it is to be understood that the disclosed embodiment is merely exemplary of the invention which may be embodied in various forms. Therefore, specific structural and functional details disclosed herein should not to be interpreted as limiting, but merely as a basis for the claims which follow hereafter and which are deemed as representative for teaching one skilled in the art to variously employ the present invention in virtually any appropriately detailed structure.

What is claimed is:

1. A warning marker device made of a unitary flat folding sheet characterized by predetermined fold lines thereon for forming an elongate cone having a longitudinal axis extending upwardly from the floor or ground upon which said marker device is intended to rest and in which the top end of said cone is truncated, and wherein said marker device is used for alerting passers-by of risk or adverse condition in the environs of said marker device, and wherein said marker device comprises:

a) first, second, third and fourth major panels separated by said predetermined fold lines on said unitary flat folding sheet forming the body of said device, and wherein said first and fourth panels are permanently attached;

b) first, second, third, and fourth minor bottom panels forming the base of said body, and wherein each said minor bottom panel begins at fold lines at the bottom edge of said first, said second, said third and fourth major panels respectively;

c) first, second, third, fourth and fifth minor top panels forming the top closure of said body, and wherein said first minor top panel begins at a fold line at the top edge of said first major panel, and wherein said second and said third minor top panels begin at a fold line at the top edge of said second major panel, and wherein said fourth and said fifth minor top panels begin at a fold line at the top edge of said fourth major panel forming a locking top closure; and, d) said second and fourth major panel, each having a vertical slot at said top end of said body, and wherein said slots are provided for insertion of a ribbon-like fencing means through said marker device.

2. A warning marker device as recited in claim 1, wherein said second and said third minor top panels are separated by a slit extending to said slot on said second major panel.

3. A warning marker device as recited in claim 1, wherein said fourth and fifth minor top panels are separated by a slit extending to said slot on said fourth major panel.

4. A warning marker device as recited in claim 1, wherein said first, second, third, fourth and fifth minor top panels, upon being folded form a top closure for covering said truncated top end, and said slots, wherein said ribbon-like fencing means is frictionally engaged to form a line of demarcation providing a warning to a passer-by.

5. A warning marker device of claim 1, wherein said four major panels, said four minor bottom panels, and said five minor top panels are all adapted to be engaged by folding said top minor panels and said bottom minor panels into said major panels so as to have said marker device in an assembled condition prepared for deployment, and upon unfolding said minor bottom panels and said minor top panels out of engagement with said major panels disassembling said marker device and thereby collapsing said marker device into a relatively flat body which is receptive to relatively convenient storage.

6. A multiplicity of further marker devices of claim 1 having said ribbon-like fencing means extending in continuation there between and being held in frictional engagement by said top minor panels through said slots at said top end of each said marker devices to thereby define a fence of discretionary length and direction that may be readily removed, stowed and redeployed without disassembling said marker devices.

7. A warning marker device made of a unitary flat folding sheet characterized by predetermined fold lines thereon for forming an elongate cone having a longitudinal axis extending upwardly from the floor or ground upon which said marker device is intended to rest and in which the top end of said cone is truncated, and wherein said marker device is used for alerting passers-by of risk or adverse condition in the environs of said marker device, and wherein said marker device comprises:

a) a plurality of major panels forming the body, and wherein each said panel is separated by said predetermined fold lines, and wherein the first and last major panels are attached;

b) a plurality of minor bottom panels forming the base, and wherein each said minor bottom panel begins at a fold line at the bottom edge of a corresponding major panel;

c) a plurality of minor top panels forming the top closure of said device, and wherein said minor top panels begin at fold lines at the top edge of said major panels forming a locking top closure; and, d) two opposing said major panels, each having a vertical slot at the top end of said marker device for the insertion of a ribbon-like fencing means in said slots.

8. A warning marker device of claim 7, wherein said plurality of major panels, said plurality of minor bottom panels, and said plurality of minor top panels are all adapted to be engaged by folding said top minor panels and said bottom minor panels into said major panels so as to have said marker device in an assembled condition prepared for deployment, and upon unfolding said minor bottom panels and said minor top panels out of engagement with said major panels disassembling said marker device and thereby collapsing said marker device into a relatively flat body which is receptive to relatively convenient storage.

9. A multiplicity of further marker devices of claim 7 having said ribbon-like fencing means extending in continuation there between and being held in frictional engagement by the top minor panels through said slots at said top end of each said marker devices to thereby define a fence of discretionary length and direction that may be readily removed, stowed and redeployed without disassembling said marker devices.

* * * * *